US006789692B2

(12) United States Patent
Prezelin

(10) Patent No.: US 6,789,692 B2
(45) Date of Patent: Sep. 14, 2004

(54) CONTAINER LATCH VALVE

(76) Inventor: Louis M. Prezelin, 1281 Ferrelo Rd., Santa Barbara, CA (US) 93103

( * ) Notice: Subject to any disclaimer, the term of this patent is extended or adjusted under 35 U.S.C. 154(b) by 0 days.

(21) Appl. No.: 10/193,839

(22) Filed: Jul. 11, 2002

(65) Prior Publication Data

US 2003/0010783 A1 Jan. 16, 2003

Related U.S. Application Data

(60) Provisional application No. 60/305,455, filed on Jul. 13, 2001.

(51) Int. Cl.[7] ..... B65D 45/16; B65D 51/16; B65D 51/04

(52) U.S. Cl. ..... 220/324; 220/366.1; 220/367.1; 220/745; 220/271; 220/231; 220/360; 220/728; 220/810; 220/835; 220/849; 220/203.11; 220/203.22; 220/203.06; 220/203.07; 190/119

(58) Field of Search ..... 220/361, 203.22, 220/324, 366.1, 367.1, 745, 271, 203.29, 231, 203.11, 203.05, 203.06, 203.07, 203.09, 203.28, 240, 360, 728, 835, 849; 190/119, 121

(56) References Cited

U.S. PATENT DOCUMENTS 2,332,245 A * 10/1943 Moll ..... 220/324
4,011,940 A * 3/1977 Neal et al. ..... 206/1.5
4,743,038 A * 5/1988 Myers et al. ..... 280/40
5,193,706 A * 3/1993 Hanna et al. ..... 220/324
5,348,185 A * 9/1994 Buckner et al. ..... 220/326
5,695,087 A * 12/1997 Tutton et al. ..... 220/324
6,276,552 B1 * 8/2001 Vervisch ..... 220/324
6,305,546 B1 * 10/2001 Saunders et al. ..... 206/541
2002/0117507 A1 * 8/2002 Doerfler et al. ..... 220/835

* cited by examiner

*Primary Examiner*—Lee Young
*Assistant Examiner*—James Smalley
(74) *Attorney, Agent, or Firm*—Kenneth J. Hovet

(57) ABSTRACT

A container is provided having corresponding shells that mate together about a joint to create an enclosed airtight container. A valve seat is formed on the exterior of a shell adjacent the joint. The valve seat has an opening in communication with the container interior. A latch assembly is used to secure the shells in a closed position. The assembly includes a latch body which is attached to a shell by a hinge fastener close to said joint. The inside face of the latch body is provided with a valve gasket having a curved outer face that is aligned and sealingly engageable with the valve seat. When the latch is closed, the gasket will seal against the valve seat. When the latch is dislodged from its connection to the other shell, the gasket will be simultaneously removed from the valve seat and allow air to flow through the opening. This action permits equalization of any pressure differentials between ambient pressure and the pressure in the container interior. This allows a user to separate the shells and gain access to the container interior.

25 Claims, 3 Drawing Sheets

CONTAINER LATCH VALVE

This application claims priority from Provisional Application No. 60/305,455 filed Jul. 13, 2001.

BACKGROUND OF THE INVENTION

1. Field of the Invention

The present invention pertains generally to airtight containers. More particularly, the present invention pertains to airtight containers having a latch valve which automatically equalizes the respective pressures inside the container and outside the container as the latch is operated to open the container.

2. Description of Related Art

Airtight containers typically include a venting device to equalize the pressure between the container interior and exterior prior to opening. This is needed because a vacuum is created within an airtight container during airline travels which can often inhibit the opening of the container. For molded plastic waterproof cases, the standard vent in the industry consists of a threaded opening in the lower shell that is plugged by a removable screw fitted with an O-ring. Such an arrangement, however, requires additional action to vent the case. Further, the additional parts and assembly required (the screw and O-ring) add to the manufacturing cost of the container. Moreover, the vent screw is frequently lost, which makes the airtight container useless for its intended application.

SUMMARY OF THE INVENTION

In light of the above, it is an object of the present invention to provide a venting latch for an airtight container that eliminates the requirement of a separate vent screw and further prevents any risk of losing the vent screw. It is another object of the present invention to provide a venting latch that requires no action to equalize pressures inside and outside the container, other than to operate the latch. An additional object of the present invention is to provide a venting latch for an airtight container that is relatively simple to use, is easy to manufacture and is comparatively cost effective.

BRIEF DESCRIPTION OF THE DRAWINGS

The novel features of this invention will be best understood from the accompanying drawings, taken in conjunction with the accompanying description, in which similar characters refer to similar parts, and in which.

DESCRIPTION OF THE PREFERRED EMBODIMENTS

Figure 1:
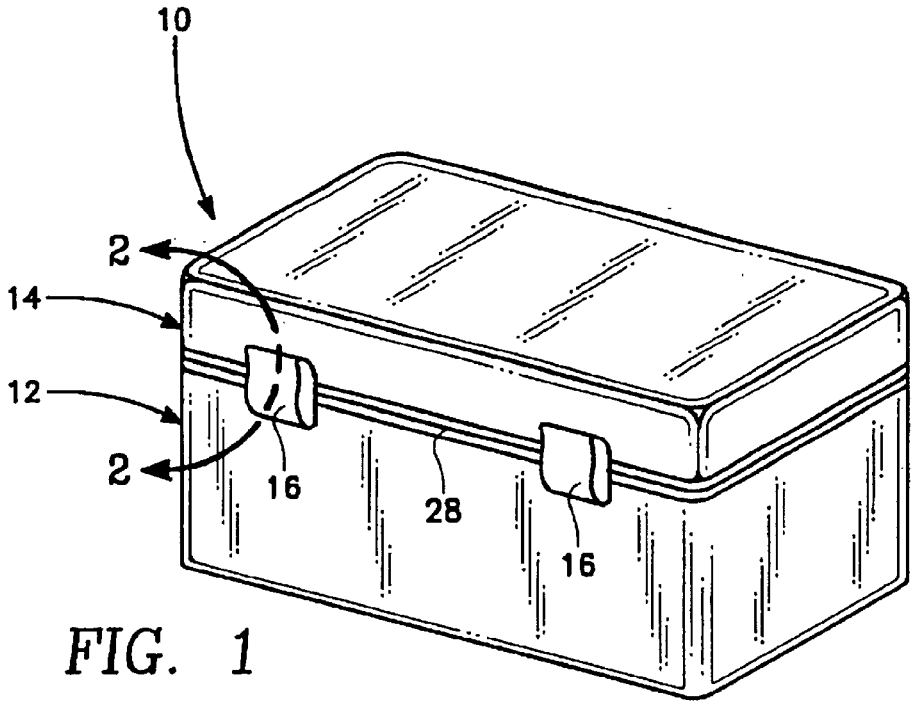
FIG. 1 is a perspective view of an airtight container which incorporates the latch valve system of the present invention.

Referring to the drawings, the self-venting airtight container of the present invention is shown and is generally designated 10. In brief overview, the container 10 includes a lower shell 12 and an upper shell 14 that are selectively and sealingly mated to each other about respective top edges to form joint 28. The joint is secured with latches 16. Different embodiments for the structure of the lower shell, upper shell and latch are more fully described below. As used herein, the terms "airtight" or "hermetically sealed" are intended to comprehend a container/enclosure that is sealed against passage of gasses or fluids.

The container 10 as shown in FIG. 1 is rectangular. It is to be appreciated, however, that the present invention encompasses all shapes and sizes of airtight/watertight containers including two or more shell combinations constituting a lid secured to a base with at least one latch. Also, the term "latch" comprehends all types of clamping and locking devices having at least a body portion into which may be fitted a gasket means for effecting a seal against a valve seat means. Without limitation, examples of fastening means useful with the present system are latch, clamp, clasp, catch, cam lock, hasp and staple devices.

Figure 2:
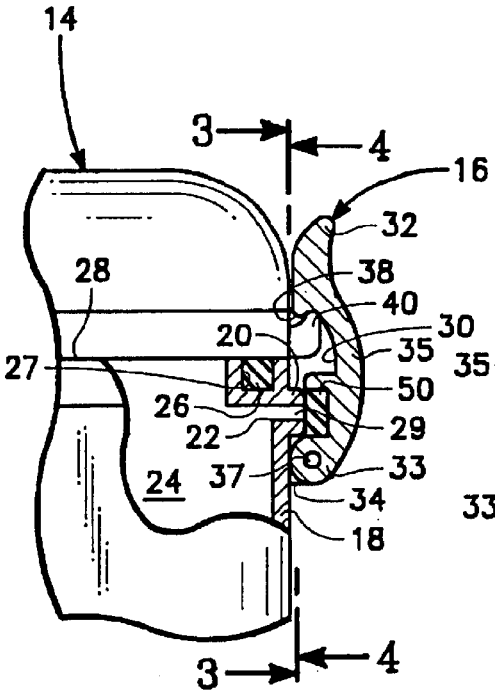
FIG. 2 is an enlarged fragmentary cross-sectional view of the container and system of FIG. 1 with a portion of the container cut away.

Referring now to FIG. 2, the structure of a first embodiment of the latch 16 and lower shell 14 is shown in greater detail. More specifically, the lower shell includes a lower shell wall 18 having a shell vent opening 22 adjacent joint 28. The vent opening merges into valve aperture 29 which is defined by an outwardly extending projection referenced as valve seat 20. The valve aperture 29 establishes a path of air communication between the container interior 24 and the ambient outside atmosphere.

As depicted in FIG. 2, a continuous seal member 26 sets within a recess 27 which extends around the perimeter of lower shell 12 proximate joint 28. When upper shell 14 is mated to the lower shell 12, the joint 28 is created. Securement is effected when the latches 16 are closed, whereby seal member 26 becomes slightly compressed to provide an airtight/watertight engagement.

Latch 16 comprises a latch body having a proximal end hingably attached to the container. A free distal end of the latch body has a latch locking part that is movable into and out of locking engagement with a corresponding container locking part. In particular, the latch body has an upper free end portion 32 that merges into a body portion 35. Extending downwardly from the body portion are two opposing lower hinge extensions 33.

To connect the latch to the lower shell, a fixed hinge mount 34 is provided that extends outwardly from lower shell wall 18 below valve seat 20. A transverse aperture 36 is formed in the hinge mount through which extends hinge pin 37. Opposing ends of the pin are attached to respective latch body hinge extensions 33.

Extending inwardly and downwardly from inner surface 30 of the latch body, proximate upper portion 32, is a transverse abutment shoulder 38. When latch 16 is in a closed position, the inner surface 30 of upper portion 32 will be in contact with upper shell 14. Simultaneously, abutment shoulder 38 will be in frictional engagement with a lip part 40 which extends outward from upper shell 14 above valve seat 20. This action thereby completes closure of the latch device.

Figure 3:
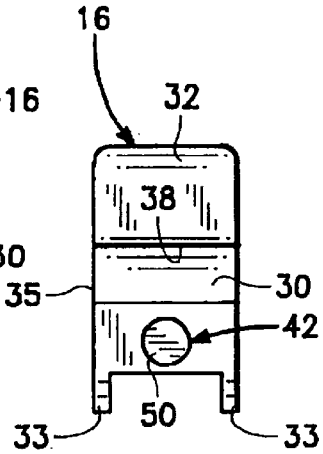
FIG. 3 is an elevational view at the inner face of the latch body shown in FIG. 2.
Figure 4:
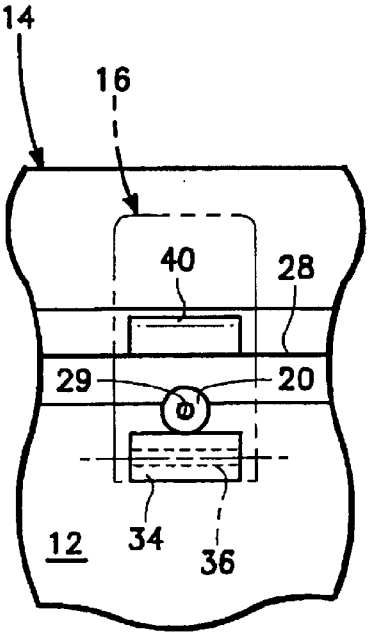
FIG. 4 is a fragmentary front elevational view of the portion of the container shown in FIG. 2, with the latch body removed from the lower shell hinge part.

As seen in FIG. 3, the inner surface 30 of the latch body includes a latch recess 42. The latch recess is defined by back wall 44 and sidewalls 45. It is preferably cylindrical in shape and extends into the latch body thickness a distance that is determined by the size and shape of the latch gasket.

The recess is provided with one or more vent outlets. In particular, venting grooves 48 are formed in the back wall and side walls. The grooves extend in a continuous manner from the back wall across the peripheral wall to latch inner surface 30. In this way, when a gasket is placed in latch recess 42 as described below, the venting grooves will allow for air passage and equalization of pressure behind the gasket when the container is closed and also when the container is opened after having undergone a differential pressure transformation.

Figure 5:
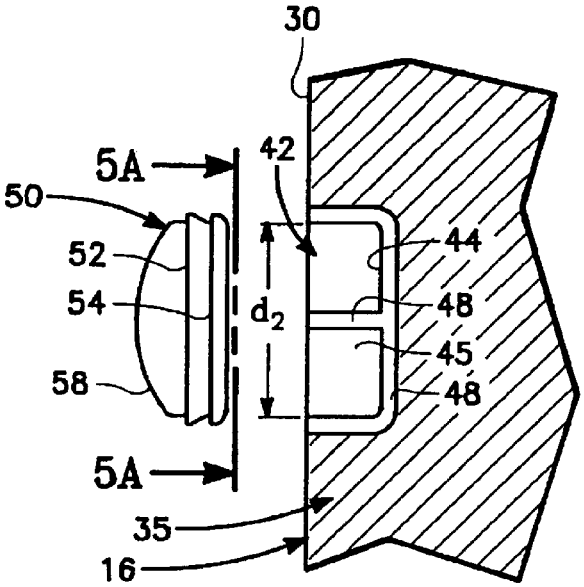
FIG. 5 is an enlarged cross-sectional fragmentary side elevational view of the lower shell with a gasket exploded from the shell.
Figure 5A:
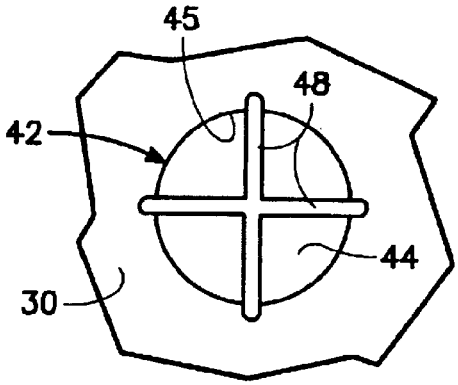
FIG. 5*a* is an elevational view taken along lines 5*a*—5*a* of FIG. 5.

As best shown in FIGS. 5 and 5A, two small intersecting venting grooves are formed in the back wall and side walls. However, other groove patterns could be used provided a vent means is created for air passage from behind the gasket to latch inner surface 30. For example, the inside surfaces of the recess may be provided with ridge lines that are continuous from the back wall and across the side walls. Or, the recess could have a polygonal cross-section and the gasket could be round whereby peripheral corners of the recess would be open for air passage.

Figure 6:
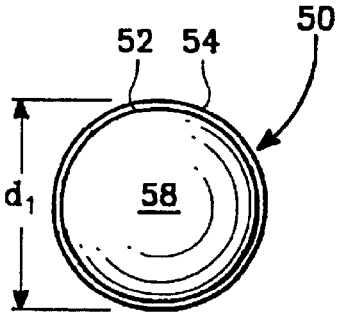
FIG. 6 is a front elevational view of the gasket shown in FIG. 5.

As depicted in FIGS. 5 and 6, the diameter $d_1$ of dome gasket 50 is chosen so that it is slightly larger than recess diameter $d_2$. This allows for a firm engagement whereby the gasket may be press-fit into the recess. The dome gasket is a solid resilient round body having a convex outer profile in side elevation. This profile provides positive contact with valve seat 20, which is tubular in shape, as the latch is closed. When in place within the latch recess, the outermost portion of the gasket contact surface 58 extends beyond latch inner surface 30 for reasons enumerated below.

The dome gasket 50 may include offset peripheral friction rings 52, 54. When the gasket is inserted into recess 42, the rings will be engaged with side wall 45 thereby ensuring a snug fit through many repeated cycles of lid opening and closing. This prevents accidental displacement of the gasket over the lifetime of the container.

Figure 9:
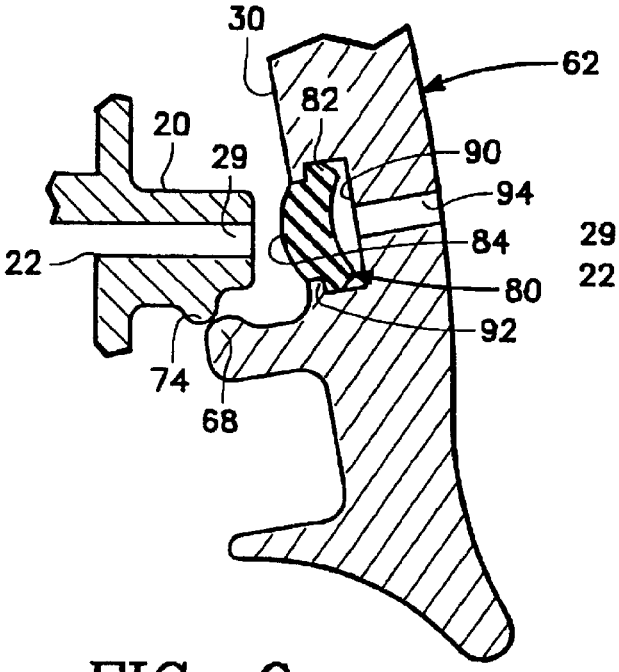
FIG. 9 is an enlarged fragmentary side elevation cross-sectional view of the latch body and valve seat depicted in FIG. 7 showing an alternative arched gasket prior to engagement with the valve seat.
Figure 10:
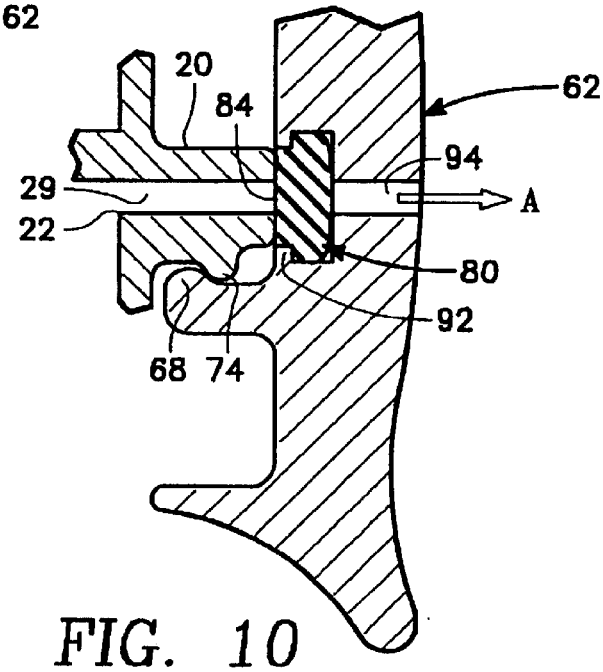
FIG. 10 is a view similar to FIG. 9 showing the arched gasket in sealing engagement with the valve seat.
Figure 11:
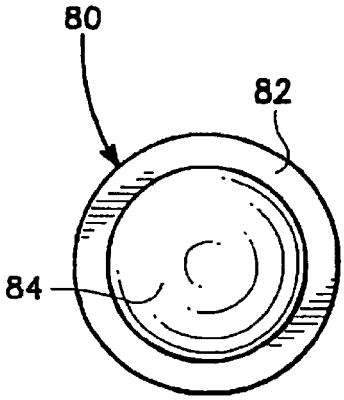
FIG. 11 is a front side elevational view of the arched gasket shown in FIG. 9.

To help ensure than an effective seal is created even if the latch is not perfectly closed or in misalignment, and to minimize elastic memory of the gasket material over time, the gasket may have a thicker dimension or it may have a convex shape as shown with dome gasket 50. FIGS. 9–11 illustrate this concept whereby an arched gasket 80 is provided. The arched outer sealing surface 84 of the gasket extends beyond latch inner surface 30 as shown in FIG. 9. When under compression, as depicted in FIG. 10, the gasket yields and becomes flattened. This yielding action provides an additional degree of accommodation to the inherent resilience of the gasket material.

Arched gasket 80 may also include a peripheral edge notch 82. The notch is adapted to interfit with a corresponding undercut 92 in enlarged recess 90 of alternative latch device 62. Because a larger inner space is created between the back side of the arched gasket and latch recess, it is desirable to provide a more direct air vent passage 94. See arrow A in FIG. 10 illustrating air movement that occurs when the arched gasket is depressed by movement of latch 62 against valve seat 20.

Figure 12:
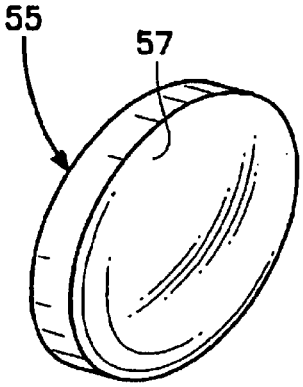
FIG. 12 is an isometric front view of a convex disc gasket.
Figure 13:
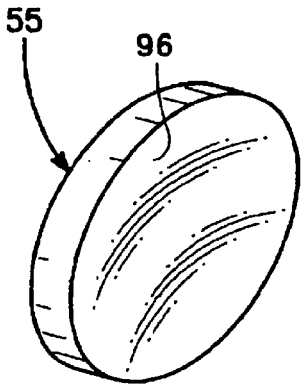
FIG. 13 is an isometric view depicting the concave back side of the gaskets shown in FIGS. 9 and 12.

FIGS. 12 and 13 illustrate a curved disc gasket 55. This gasket has a uniform thickness that is preformed to have a convex shape similar to the arched gasket 80. The outer disc sealing surface 57 is curved outwardly beyond latch inner surface 30 and becomes flattened upon engagement with valve seat 20. Simultaneously, the concave disc backside 96 also becomes flattened against the latch recess back wall.

Preferably, the gaskets are made of resilient polymeric or rubberized materials such as neoprene. However, industrial plastics such as low density polyethylene (LDPE) are also envisioned. The gasket material is chosen for wear resistence, resilience and minimal gasket memory over time.

In operation, the latch device 16 is located to overlie valve seat 20 and extend across joint 28 between the upper and lower shells 12 and 14. Securement occurs by rotating the latch body until abutment shoulder 38 and lip part 40 become frictionally engaged. This action will cause valve seat 20 to press against a latch gasket and create an airtight seal. The seal becomes stronger as external pressure on the container increases. If inside pressure builds up, excess air may bleed through the lid seal member 26. When the latch 16 is opened by pulling upper latch portion 32 away from upper shell 14, the seal between the valve seat and gasket will be broken. Air pressure between the container interior 24 and the outside atmosphere is thereby equalized automatically by movement of air through valve aperture 29.

Figure 7:
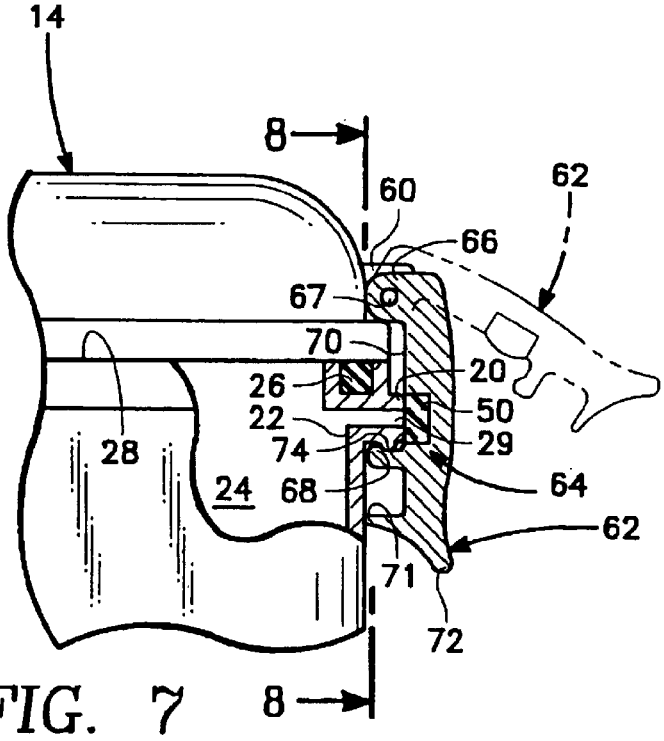
FIG. 7 is a fragmentary cross-sectional view of an alternative embodiment showing the latch body hinged to the container upper shell.
Figure 8:
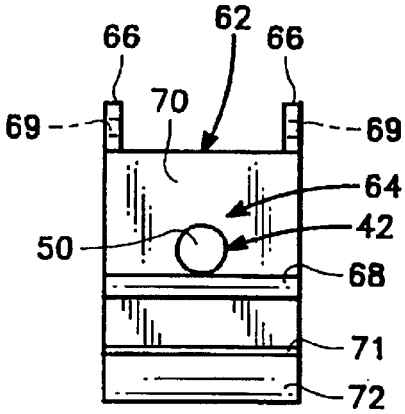
FIG. 8 is an elevational view of the inside surface of the latch body of FIG. 7.

Referring now to FIGS. 7–8, an alternative embodiment of the latch and container system is shown. An upper shell hinge mount 60 extends outwardly from the front wall of upper shell 14 above valve seat 20. An alternative latch device 62 has a central body 64 that terminates at opposing upper arms 66, 66 that extend upwardly and inwardly from the central body. The upper arms are connected to respective opposing ends of upper shell hinge mount 60. A cross pin 67 extends through a corresponding mount aperture. Opposing ends of the pin terminates at pin openings 69, 69 in respective arms 66, 66 to hingably connect the latch central body 64 to upper shell 14.

The central body 64 includes a friction flange 68 that extends inwardly from latch inner face 70. The central body also includes an inwardly directed latch recess 42 and gasket 50. The latch recess and gasket may have the same structure as in the first embodiment discussed above. The central body 64 extends downwardly to a free end referenced as latch head 72.

During operation of alternative latch 62, peripheral edges at the container upper shell and lower shell are mated together. Latch 62 is then moved toward the lower shell until spacer bar 71 contacts lower shell wall 18. When this occurs, flange 68 will be frictionally engaged with an underhang structure 74 which extends downwardly from the lower portion of valve seat 20. The engagement will secure the latch 62 in a closed position. Concurrently, the latch gasket becomes slightly compressed and establishes a seal between the valve seat 20 and gasket as discussed above.

To open the container, latch head 72 is grasped and rotated away from the lower shell wall. When this occurs, friction flange 68 becomes disengaged from underhang 74. Simultaneously, the seal between gasket 50 and valve seat 20 is broken and pressure differentials are equalized as discussed above.

The foregoing is considered as illustrative only of the principles of the invention. Since other modifications and changes will readily occur to those skilled in the art, it is not desired to limit the invention to the exact construction and operation shown and described. Accordingly, all suitable modifications and equivalents may be resorted to, falling within the scope of the invention as claimed.

I claim:

1. A container comprising a first shell and second shell with mating surfaces that are mutually engagable to form a joint, said shells being held together upon securement with at least one latch having a latch body that extends across said joint from said first shell to said second shell, wherein:

said first shell has a vent opening;

said latch body has an inner surface with a recess;

a valve gasket attached to said recess;

said first shell having a valve seat positioned to engage said valve gasket, said valve seat having a valve aperture in communication with said vent opening; wherein said valve gasket overlies said valve seat to close said valve aperture during said securement.

2. A The container of claim 1 wherein said valve gasket has a convex surface that contacts said valve seat during said securement.

3. The container of claim 1 wherein said valve seat comprises a tubular projection containing said aperture.

4. The container of claim 1 wherein said valve gasket extends into said recess.

5. The container of claim 4 wherein said recess has a back wall from which extends a sidewall, including venting grooves in said back wall and sidewall.

6. The container of claim 4 wherein said latch body has a thickness and includes a latch vent aperture extending from said recess through said thickness.

7. The container of claim 4 wherein said recess has a peripheral undercut portion for constraining said valve gasket in said recess.

8. The container of claim 1 wherein said at least one latch is hingably attached to said second shell.

9. The container of claim 1 wherein said first shell has an exterior and said valve seat comprises a projection extending outwardly from said exterior, said projection having an outer rim surface that is sealingly engagable with said valve gasket.

10. The container of claim 1 wherein said vent opening and said valve aperture are coextensive.

11. The container of claim 1 wherein said valve seat is located adjacent to said joint.

12. The container of claim 1 wherein said recess includes vent means for allowing fluid to flow between an outside of said container and said recess during engagement of said valve gasket to said valve seat.

13. The container of claim 12 wherein said recess has interior surfaces and said vent means comprises flow channels extending into said surfaces.

14. The container of claim 12 wherein said vent means comprises a latch vent aperture extending from said recess through said latch body.

15. The container of claim 1 wherein said recess has an inner peripheral notch and said valve gasket has an outer periphery that is in engagement with said notch.

16. The container of claim 1 wherein said valve gasket has a convex surface that engages said valve seat.

17. The container of claim 1 wherein said valve gasket has a disc shape that is curved outwardly.

18. The container of claim 1 wherein said valve gasket is a plug with a domed outer surface.

19. The container of claim 18 where in said plug includes at least one peripheral friction ring.

20. A container configured to equalize pressure upon unlatching a latch, the container comprising:

a) a first shell with a first wall having an inner surface and an outer surface, said first shell having an outer periphery with a primary seal engagement member;

b) a second shell with an outer periphery having a complementary seal engagement member configured to sealably engage said primary seal engagement member;

c) a vent extending through said first wall;

d) a valve seat on said outer surface and circumscribing said vent;

e) a valve gasket with a front surface and a rear surface; and, f) a latch for coupling said first shell with said second shell, said latch comprising an inner face and an outer face, said inner face having a retainer means for constraining said valve gasket, wherein, in a latched orientation, said front surface of said valve gasket sealably engages said valve seat, and wherein, in an unlatched orientation, said front surface of said valve gasket does not sealably engage said valve seat.

21. The watertight container of claim 20 further comprising at least one channel for allowing fluid passage from said outside of said container to said rear surface of said valve gasket.

22. The watertight container of claim 21 wherein said retainer means comprises an indentation with said inner surface of said latch, said at least one channel comprising a hole extending from said inner surface of said latch to said outer surface of said latch.

23. The watertight container of claim 21 wherein said retainer means comprises an indentation with said inner face of said latch, said at least one channel comprising grooves formed in said inner face of said indentation, said grooves forming a fluid path partially abutted by said valve gasket.

24. The watertight container of claim 20 wherein securing said latch exerts a compressive force between said first and second shell, whereby said primary seal engagement member is urged to sealably engage with said complementary seal engagement member.

25. The container of claim 20 wherein said latch has a first end with a first coupling means for coupling with said first shell, said latch having a second end with a second coupling means for coupling with said second shell, said valve gasket being disposed between said first coupling means and said second coupling means.

* * * * *